US008057000B2

(12) United States Patent
Imanaka et al.

(10) Patent No.: US 8,057,000 B2
(45) Date of Patent: Nov. 15, 2011

(54) ELEMENT SUBSTRATE, PRINTHEAD, HEAD CARTRIDGE, AND PRINTING APPARATUS

(75) Inventors: Yoshiyuki Imanaka, Kawasaki (JP); Souta Takeuchi, Yokohama (JP); Takuya Hatsui, Tokyo (JP); Takaaki Yamaguchi, Yokohama (JP); Takahiro Matsui, Yokohama (JP); Kousuke Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/910,094

(22) Filed: Oct. 22, 2010

(65) Prior Publication Data

US 2011/0032295 A1 Feb. 10, 2011

Related U.S. Application Data

(63) Continuation of application No. 11/947,515, filed on Nov. 29, 2007, now Pat. No. 7,841,678.

(30) Foreign Application Priority Data

Dec. 4, 2006 (JP) ..... 2006-327625

(51) Int. Cl.
*B41J 29/38* (2006.01)

(52) U.S. Cl. ..... 347/9; 347/5; 347/19

(58) Field of Classification Search ..... 347/5, 9, 347/12, 14, 19; 368/204
See application file for complete search history.

(56) References Cited

U.S. PATENT DOCUMENTS

| | | | | |
|---|---|---|---|---|
| 3,898,790 | A * | 8/1975 | Takamune et al. | 368/204 |
| 5,114,252 | A | 5/1992 | Tanuma et al. | |
| 5,828,386 | A | 10/1998 | Okada et al. | |
| 6,224,184 | B1 | 5/2001 | Imanaka et al. | |
| 6,293,655 | B1 | 9/2001 | Imanaka et al. | |
| 7,309,120 | B2 | 12/2007 | Hatsui et al. | |
| 2005/0285904 | A1 | 12/2005 | Toge et al. | |
| 2007/0002087 | A1 | 1/2007 | Matsui et al. | |
| 2007/0103501 | A1 | 5/2007 | Hatsui et al. | |

* cited by examiner

*Primary Examiner* — Lam S Nguyen
(74) *Attorney, Agent, or Firm* — Fitzpatrick, Cella, Harper & Scinto

(57) ABSTRACT

This invention relates to an element substrate capable of confirming an electrical connection status before a printhead malfunctions. The element substrate is a substrate for a printhead, which is detachable from a printing apparatus and includes a plurality of printing elements, a logical circuit for controlling the printing elements, and a voltage application terminal for applying a driving voltage to drive the printing elements. The logical circuit is driven at a voltage lower than the driving voltage. The element substrate includes a connection status output circuit which outputs a signal reflecting the electrical connection status between the printhead and the printing apparatus on the basis of the driving voltage.

13 Claims, 8 Drawing Sheets

ELEMENT SUBSTRATE, PRINTHEAD, HEAD CARTRIDGE, AND PRINTING APPARATUS

This application is a continuation of U.S. patent application Ser. No. 11/947,515, filed Nov. 29, 2007.

BACKGROUND OF THE INVENTION

1. Field of the Invention

The present invention relates to a printhead element substrate having a connection status output circuit which outputs a signal reflecting the electrical connection status between a printhead and a printing apparatus, a printhead, a head cartridge, and a printing apparatus.

2. Description of the Related Art

An inkjet printing apparatus is a so-called non-impact printer and is capable of executing high-speed printing, printing on various kinds of print media, and almost noise-free printing. For these reasons, the inkjet printing apparatus is widely employed as an apparatus serving as the printing mechanism of a printer, copying machine, facsimile apparatus, or wordprocessor.

Well-known typical ink discharge methods adopted by a printhead in an inkjet printing apparatus are, e.g., a method using an electromechanical transducer such as a piezoelectric element, and a method using an electrothermal transducer (heater) which heats ink to discharge ink droplets by a film boiling effect.

A printing apparatus having such an inkjet printhead can output high-resolution characters and images at a low cost. Especially, the printer which discharges ink droplets by the film boiling effect commands a large share of the market because it can perform color printing at a low cost.

The number of orifices of a printhead increases from 64 to 128 or 256 with a tendency toward a higher image quality. The number of orifices per inch (dpi) increases to 300 dpi or 600 dpi, and the orifices are arranged at a high density. A heater serving as an electrothermal transducer arranged in correspondence with each orifice forms bubbles by film boiling upon receiving a heat pulse in the order of several to 10 μsec. Such high-frequency driving implements high-speed high-quality printing.

A unit for electrically connecting the printhead in the inkjet printing apparatus is provided on the carriage which reciprocally moves the attached printhead. More specifically, the carriage has a plurality of contacts. When the printhead is attached to the carriage, these contacts come into contact with a plurality of contacts provided on the printhead side. This ensures electrical connection between the printhead and the inkjet printing apparatus.

U.S. Pat. No. 5,828,386 discloses a printhead having a unit for monitoring the electrical connection status. More specifically, the printhead comprises an AND circuit which calculates the logical product of print data input from a printing apparatus to the printhead, a clock signal to transfer the print data, and a logical signal to make the apparatus execute a printing operation corresponding to the print data, and an output terminal which outputs the calculation result. This arrangement prevents any print failure such as lack of printing dots or printhead malfunction caused by a contact failure. Such a unit for confirming the connection status is particularly important in an ink-tank-integrated printhead detachable from the main body of an inkjet printing apparatus.

In this prior art, after confirming that the contact statuses of terminals for receiving logical signals (e.g., print data, clock signal, and control signal) are normal, a high voltage of, e.g., 24 V is applied to the printhead. If the terminals short-circuit, or a wiring portion that receives the high voltage has a connection error, the printhead may malfunction even when the contact statuses of the terminals appear to be normal.

SUMMARY OF THE INVENTION

The present invention is directed to an element substrate, printhead, head cartridge, and printing apparatus.

The present invention has been made to solve the above-described problem. It is an object of the present invention to provide a printhead element substrate capable of outputting a signal that reflects an electrical connection status representing whether a voltage to drive a printing element is normally applied to a printhead. It is another object to provide a printhead element substrate capable of outputting a signal that reflects an electrical connection status between a printing apparatus and a printhead before the printhead malfunctions.

According to one aspect of the present invention, preferably, there is provided an element substrate for a printhead, which is detachable from a printing apparatus and includes a plurality of printing elements, a voltage application terminal for applying a driving voltage to drive the printing elements, and a logical circuit which is driven at a voltage lower than the driving voltage to control the printing elements, comprising:

a connection status output circuit which outputs a signal reflecting an electrical connection status between the printhead and the printing apparatus on the basis of the voltage applied from the voltage application terminal.

According to another aspect of the present invention, preferably, there is provided a printhead comprising an element substrate which is detachable from a printing apparatus and includes a plurality of printing elements, a voltage application terminal for applying a driving voltage to drive the printing elements, and a logical circuit which is driven at a voltage lower than the driving voltage to control the printing elements, the element substrate comprising:

a connection status output circuit which outputs a signal reflecting an electrical connection status between the printhead and the printing apparatus on the basis of the voltage applied from the voltage application terminal.

According to still another aspect of the present invention, preferably, there is provided a head cartridge having an ink tank containing ink and a printhead comprising an element substrate which is detachable from a printing apparatus and includes a plurality of printing elements, a voltage application terminal for applying a driving voltage to drive the printing elements, and a logical circuit which is driven at a voltage lower than the driving voltage to control the printing elements, the element substrate comprising:

a connection status output circuit which outputs a signal reflecting an electrical connection status between the printhead and the printing apparatus on the basis of the voltage applied from the voltage application terminal.

According to still another aspect of the present invention, preferably, there is provided a printing apparatus using a printhead comprising an element substrate which is detachable from a printing apparatus and includes a plurality of printing elements, a voltage application terminal for applying a driving voltage to drive the printing elements, and a logical circuit which is driven at a voltage lower than the driving voltage to control the printing elements, comprising:

input means for inputting a signal output from a connection status output circuit which is provided on the element substrate and outputs a signal reflecting an electrical connection status between the printhead and the printing apparatus on the basis of the voltage applied from the voltage application terminal when a voltage is applied from the voltage application terminal to the printhead;

determination means for determining an electrical connection on the basis of the signal input to the input means; and control means for controlling to stop voltage application to the printhead before the voltage applied from the printing apparatus exceeds a breakdown voltage of the logical circuit if the determination means determines that the electrical connection status is abnormal.

The invention is particularly advantageous since it can provide a printhead element substrate capable of outputting a signal that reflects an electrical connection status between a printing apparatus and a printhead when applying a voltage to drive a printing element, and an inexpensive and reliable printhead.

Further features of the present invention will become apparent from the following description of exemplary embodiments (with reference to the attached drawings).

DESCRIPTION OF THE EMBODIMENTS

An embodiment of the present invention will be described next with reference to the accompanying drawings.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

An "element substrate" in the description indicates not a simple substrate made of a silicon semiconductor but a substrate with elements and wirings.

The expression "on an element substrate" indicates not only "on the surface of an element substrate" but also "inside of an element substrate near its surface". The term "built-in" in the present invention indicates not "simply arrange separate elements on a substrate" but "integrally form and manufacture elements on an element substrate in a semiconductor circuit manufacturing process".

FIGS. 4A to 6 are views for explaining a suitable printhead (head cartridge) which uses or practices the present invention. The configuration elements will be described below with reference to these drawings.

Figure 4B:
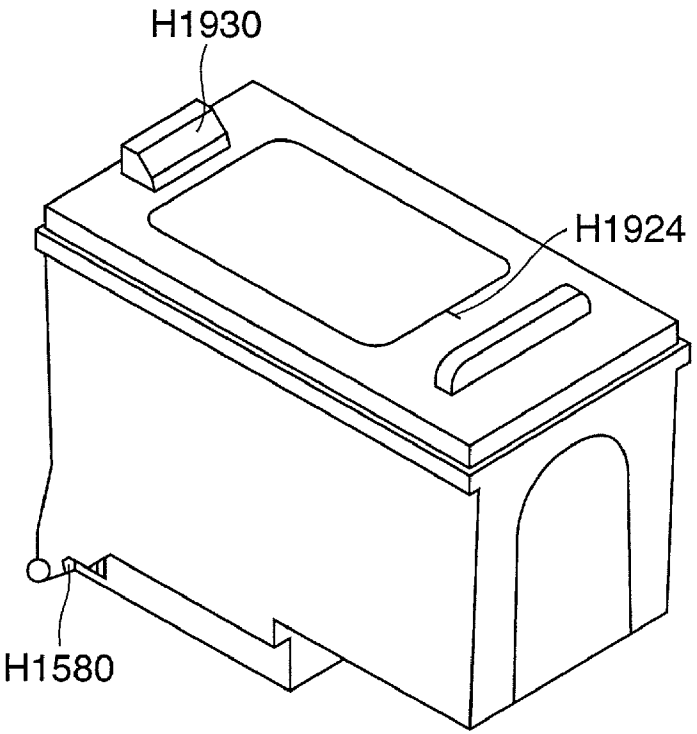
FIGS. 4A and 4B are perspective views for explaining a first printhead according to an embodiment of the present invention.
Figure 4A:
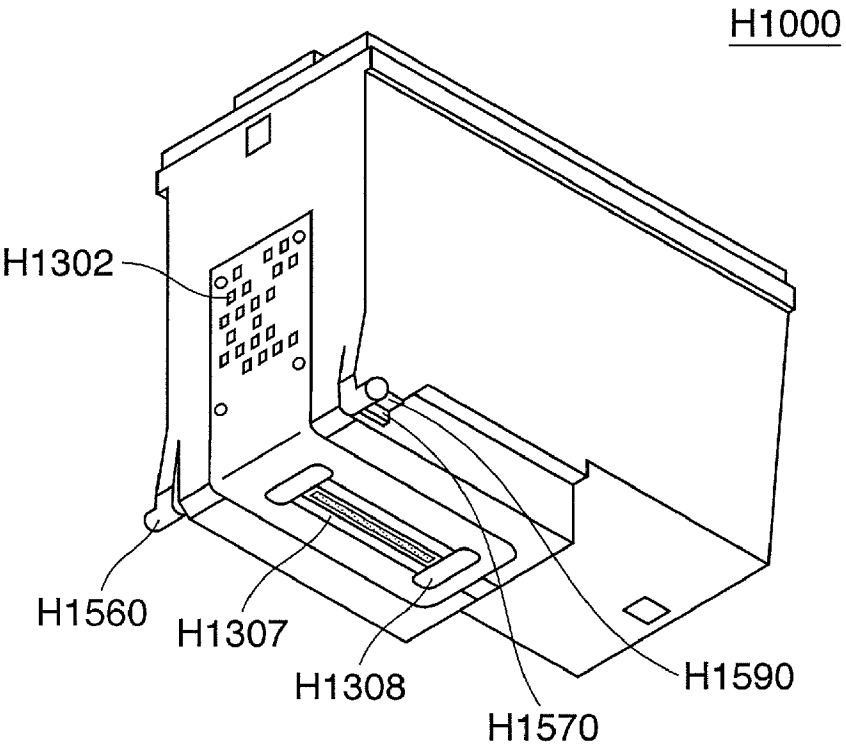

The printhead of this embodiment is of an ink-tank-integrated type which contains ink. The printhead includes a first printhead H1000 filled with black ink, as shown in FIGS. 4A and 4B, and a second printhead H1001 (not shown) filled with color inks (cyan ink, magenta ink, and yellow ink). These printheads H1000 and H1001 are fixed and supported on a carriage in an inkjet printing apparatus through a positioning unit and electrical contacts. The printheads are detachable from the carriage. Each printhead is exchangeable when the ink in it is consumed.

The configuration elements of the printheads H1000 and H1001 will be described below in detail.

(Printhead)

The first printhead H1000 and second printhead H1001 are Bubble-Jet® printheads using electrothermal transducers which generate thermal energy to cause film boiling in ink in accordance with an electrical signal. They are so-called side-shooter printheads including electrothermal transducers opposing orifices.

The first printhead H1000 and second printhead H1001 have the same basic arrangement, and the first printhead H1000 will mainly be described below.

(1-1) First Printhead H1000

Figure 5:
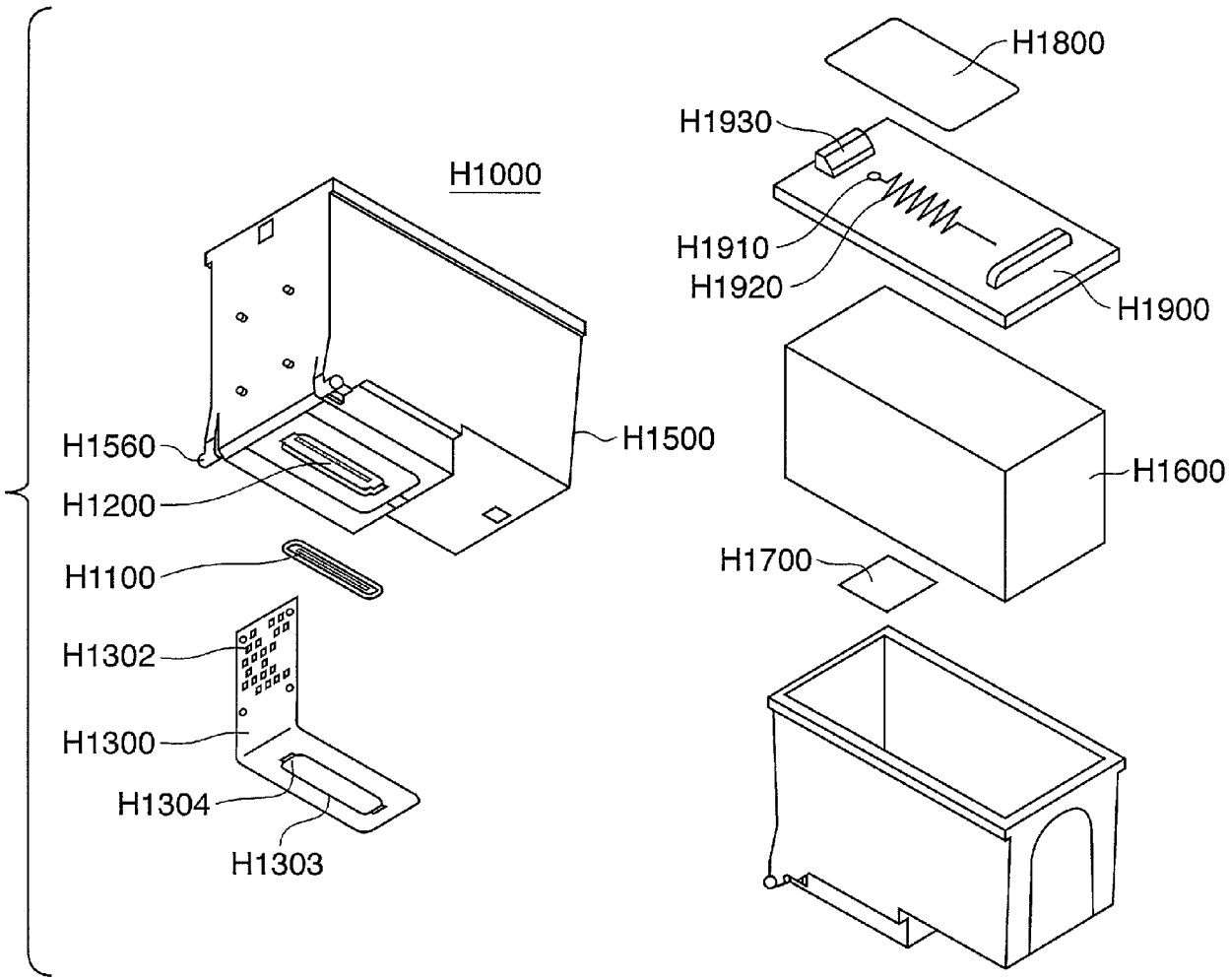
FIG. 5 is an exploded perspective view showing the first printhead according to an embodiment of the present invention.

FIG. 5 is an exploded perspective view of the first printhead H1000. The first printhead H1000 includes a first printing element substrate H1100, electrical wiring tape H1300, ink supply holding member H1500, filter H1700, ink absorber H1600, lid member H1900, and seal member H1800.

(1-1-1) First Printing Element Substrate H1100

Figure 6:
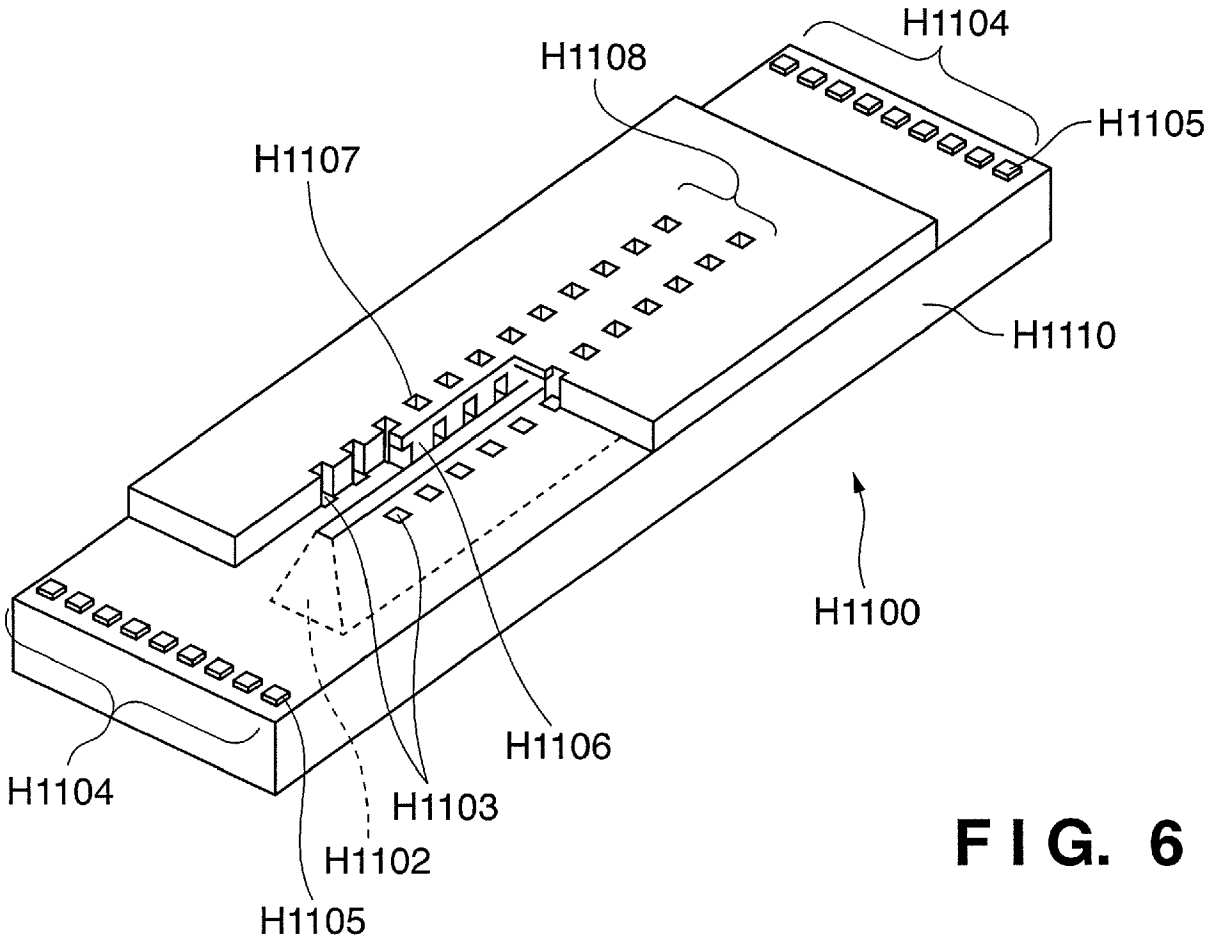
FIG. 6 is a partially cutaway perspective view showing a first element substrate included in the first printhead according to an embodiment of the present invention.

FIG. 6 is a partially cutaway perspective view for explaining the first printing element substrate H1100. The first printing element substrate H1100 is prepared by, e.g., forming, in a 0.5 to 1 mm thick Si substrate H1110, an ink supply port H1102 as a long-groove-shaped through-hole serving as an ink channel by anisotropic etching using the crystal orientation of Si or sandblast.

The Si substrate H1110 has an array of electrothermal transducers H1103 on each side of the ink supply port H1102. The Si substrate H1110 also has electrical wirings (not shown) which are made of, e.g., Al and supply power to the electrothermal transducers H1103. The electrothermal transducers H1103 and electrical wirings can be formed using an existing film formation technique. The electrothermal transducers H1103 of the two arrays are staggered with each other. That is, the orifices of the two arrays are slightly shifted from each other not to stand in a line perpendicular to the array direction.

The Si substrate H1110 also has electrode portions H1104 which supply power to the electrical wirings or an electrical signal to drive the electrothermal transducers H1103. The electrode portions H1104 are arranged along sides located at both ends of each array of the electrothermal transducers H1103. Bumps H1105 made of, e.g., Au are formed on each electrode portion H1104.

A structure which is made of a resin and has an ink channel corresponding to each electrothermal transducer H1103 is formed by photolithography on the surface of the Si substrate H1110 with a pattern of memory elements such as wirings and resistive elements. This structure has ink channel walls H1106 which partition the ink channel, and a ceiling portion which covers the ink channel. Orifices H1107 are formed in the ceiling portion. The orifices H1107 oppose the electrothermal transducers H1103, respectively, thereby forming an orifice group H1108.

In the Si substrate H1110 having the above-described structure, ink is supplied from the ink supply port H1102 and discharged from the orifices H1107 opposing the electrothermal transducers H1103 by the pressure of bubbles produced by heat generated by the electrothermal transducers H1103.

(1-1-2) Electrical Wiring Tape H1300

The electrical wiring tape H1300 forms an electrical signal path to apply, to the first printing element substrate H1100, an electrical signal to discharge ink. The electrical wiring tape H1300 is obtained by forming a wiring pattern of copper foil on a base material of polyimide. The electrical wiring tape H1300 has an opening portion H1303 to fit the first printing element substrate H1100. Electrode terminals H1304 to be connected to the electrode portions H1104 of the first printing element substrate H1100 are formed near the edge of the opening portion. The electrical wiring tape H1300 also has external signal input terminals H1302 to receive an electrical signal from the main body apparatus. The external signal input terminals H1302 and electrode terminals H1304 are connected by a continuous wiring pattern of copper foil.

The electrical connection between the electrical wiring tape H1300 and the first printing element substrate H1100 is ensured by electrically joining the bumps H1105 of the first printing element substrate H1100 to the electrode terminals H1304 of the electrical wiring tape H1300 by ultrasonic thermocompression bonding.

(1-1-3) Ink Supply Holding Member H1500

As shown in FIG. 5, the ink supply holding member H1500 having the ink absorber H1600 for holding ink inside and generating a negative pressure has a function of an ink tank. The ink supply holding member H1500 which forms an ink channel to guide the ink to the first printing element substrate H1100 also has an ink supply function.

The filter H1700 for preventing dust invasion into the first printing element substrate H1100 is welded to the boundary portion between the ink channel and the portion where the ink from the ink absorber H1600 located upstream of the ink channel is supplied.

An ink supply port H1200 for supplying black ink to the first printing element substrate H1100 is formed downstream of the ink channel. To make the ink supply port H1102 of the first printing element substrate H1100 communicate with the ink supply port H1200 of the ink supply holding member H1500, the first printing element substrate H1100 is accurately bonded and fixed to the ink supply holding member H1500.

The flat surface around the bonded surface of the first printing element substrate H1100 and part of the lower surface of the electrical wiring tape H1300 are bonded and fixed by an adhesive. The electrical connection portion between the first printing element substrate H1100 and the electrical wiring tape H1300 is sealed by a first sealing compound H1307 and a second sealing compound H1308, thereby protecting the electrical connection portion from physical impact or corrosion caused by ink. The first sealing compound H1307 mainly seals the reverse side of the connection portion between the electrode terminals H1302 of the electrical wiring tape H1300 and the bumps H1105 of the first printing element substrate H1100, and the outer peripheral portion of the first printing element substrate H1100. The second sealing compound H1308 seals the obverse side of the above-described connection portion. The unbonded portion of the electrical wiring tape H1300 is bent and fixed by, e.g., bonding to a side surface of the ink supply holding member H1500, which is almost perpendicular to the bonded surface of the first printing element substrate H1100.

(1-1-4) Lid Member H1900

The lid member H1900 is welded to the upper opening portion of the ink supply holding member H1500 to hermetically seal the ink supply holding member H1500. The lid member H1900 has a narrow port H1910 to relieve a pressure variation in the ink supply holding member H1500 and a small groove H1920 communicating with the narrow port H1910. The seal member H1800 covers most of the narrow port H1910 and small groove H1920 except one end of the small groove H1920 so that an air communicating port H1924 is formed. The lid member H1900 has an engaging portion H1930 to fix the first printhead to the inkjet printing apparatus.

(1-2) Second Printhead H1001

The second printhead H1001 discharges three color inks: cyan, magenta, and yellow inks.

Attachment of the above-described printheads to the inkjet printing apparatus will be described next in detail.

As shown in FIG. 4A, the first printhead H1000 has an attachment guide H1560 to guide the printhead to the attachment position of the carriage of the inkjet printing apparatus main body. The first printhead H1000 also has the engaging portion H1930 to fix the printhead to the carriage by a head set lever. The first printhead H1000 also has a butt portion H1570 in the carriage scanning direction, a butt portion H1580 in the print medium conveyance direction, and a butt portion H1590 in the ink discharge direction to position the printhead to a predetermined attachment position of the carriage. Positioning by these butt portions enables to accurately bring the external signal input terminals H1302 on the electrical wiring tape H1300 into electrical contact with the contact pins of an electrical connection portion provided in the carriage. The second printhead H1001 is attached in the same way as the first printhead H1000.

<Inkjet Printing Apparatus>

Figure 7:
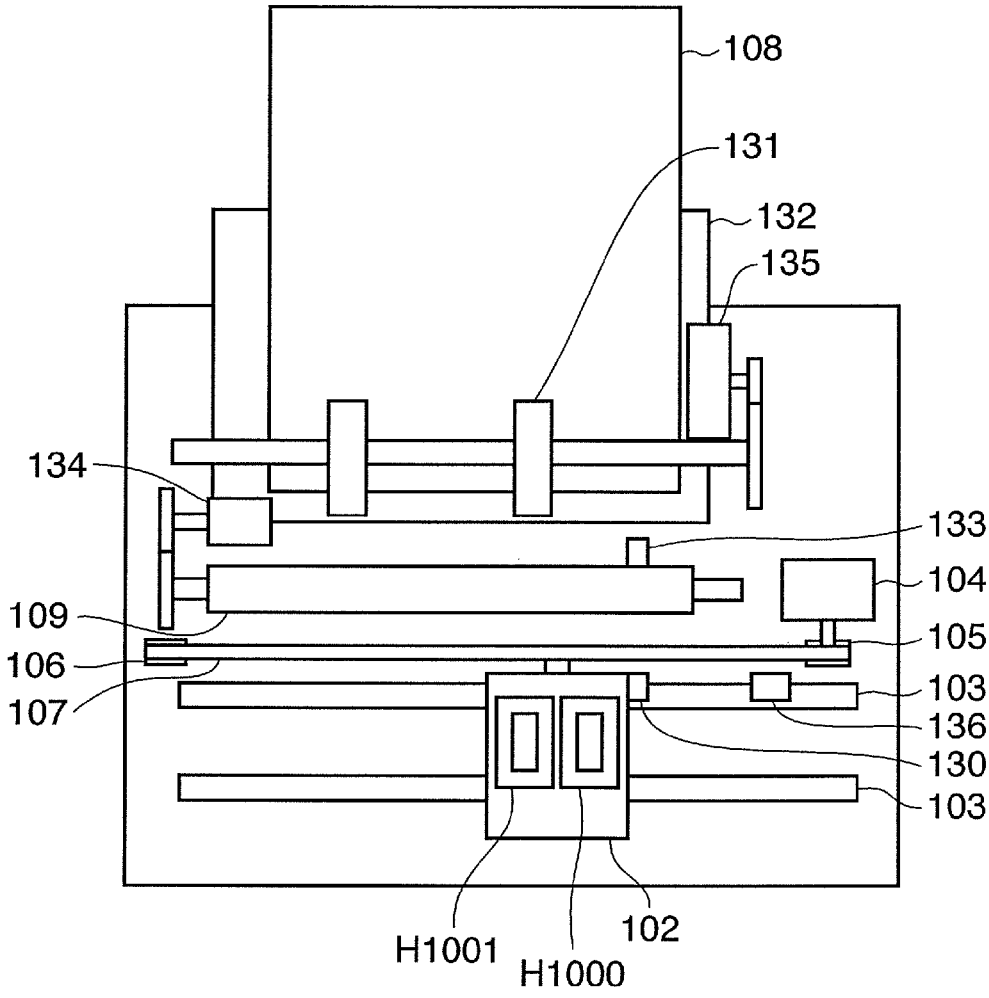
FIG. 7 is a schematic view showing an example of the inkjet printing apparatus according to the present invention.

A liquid discharge printing apparatus capable of incorporating the above-described cartridge type printhead will be described next. FIG. 7 is an explanatory view showing an example of a printing apparatus capable of incorporating the inkjet printhead according to the present invention.

Referring to FIG. 7, the printing apparatus has a carriage 102 to which the first printhead H1000 shown in FIGS. 4A and 4B and the second printhead H1001 (not shown) are positioned and attached exchangeably. The carriage 102 has an electrical connection portion to transmit logical signals and driving voltages to the discharge units through the logical signal input terminals and driving voltage application terminals on the printheads H1000 and H1001.

The carriage 102 is supported to be reciprocally movable along guide shafts 103 that are installed in the apparatus main body and run in the scanning direction. Driving of the carriage 102 and its position and movement control are executed by a scanning motor 104 through a driving mechanism including a motor pulley 105, idler pulley 106, and timing belt 107. The carriage 102 has a home position sensor 130. A position regarded as the home position is detected when the home position sensor 130 on the carriage 102 passes through the position of a shield plate 136.

As a feed motor 135 rotates pickup rollers 131 through gears, a print medium 108 such as print paper or a thin plastic plate is separated from an auto sheet feeder (ASF) 132 one by one and fed. The print medium 108 is conveyed through a position (print unit) opposing the orifice surfaces of the printheads H1000 and H1001 as a conveyance roller 109 rotates. Drive of an LF motor 134 is transmitted to the conveyance roller 109 through gears. Determination of the presence/absence of print medium feed and the sheet top detecting position is done when the print medium 108 passes through a paper end sensor 133. The paper end sensor 133 is also used to detect the actual location of the trailing edge of the print medium 108 and finally specify the current print position on the basis of the actual trailing edge position.

A platen (not shown) supports the reverse surface of the print medium 108 to form a flat print surface in the print unit. In this case, the printheads H1000 and H1001 attached to the carriage 102 are held while making their orifice surfaces project downward from the carriage 102 and parallel to the print medium 108 between the two sets of conveyance roller pairs.

The printheads H1000 and H1001 are attached to the carriage 102 while making the orifice array direction of each discharge unit perpendicular to the scanning direction of the carriage 102. The orifice arrays discharge a liquid to print.

When a printhead having the same structure as the printhead H1001 and containing light magenta, light cyan, and black inks is used in place of the printhead H1000, the printing apparatus can serve as a high-quality photo-printer.

<Control Arrangement>

A control arrangement for executing print control of the above-described inkjet printing apparatus will be described next.

Figure 8:
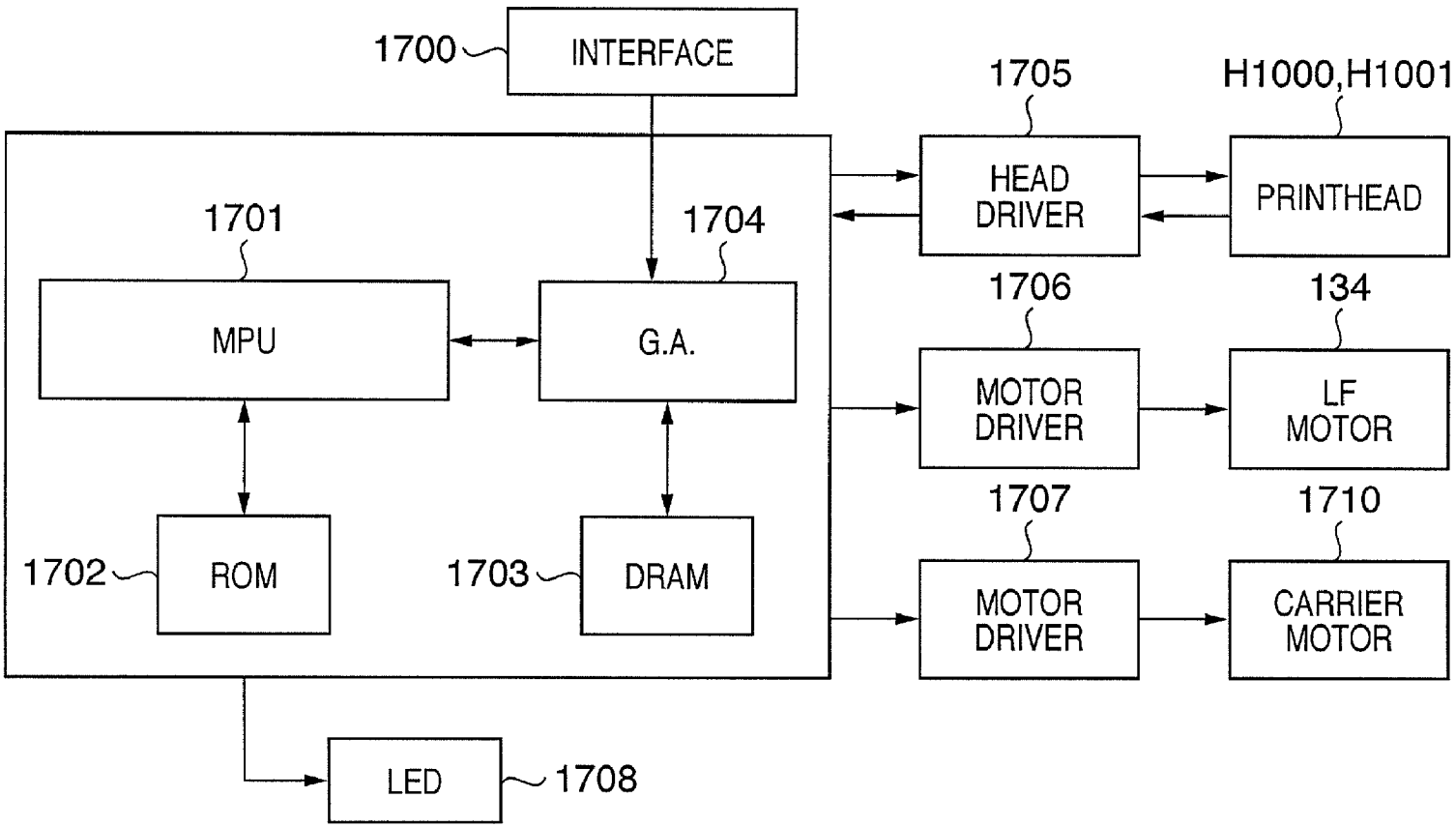
FIG. 8 is a block diagram showing the control arrangement of the inkjet printing apparatus according to the present invention.

FIG. 8 is a block diagram showing the arrangement of the control circuit of the inkjet printing apparatus.

Referring to FIG. 8, reference numeral 1700 denotes an interface that inputs a print signal; 1701, an MPU; 1702, a ROM that stores a control program to be executed by the MPU 1701; and 1703, a DRAM that saves various kinds of data (e.g., the print signal and print data to be supplied to the printheads H1000 and H1001). A gate array (G.A.) 1704 controls print data supply to the printheads H1000 and H1001 and data transfer between the interface 1700, MPU 1701, and RAM 1703. A carrier motor 1710 conveys the printheads H1000 and H1001. The LF motor 134 conveys a print medium. A head driver 1705 drives the printheads H1000 and H1001. A motor driver 1706 drives the LF motor 134. A motor driver 1707 drives the carrier motor 1710. An LED 1708 is arranged to, e.g., notify an electrical connection error by emitting light.

The operation of the control arrangement will be described. When a print signal is input to the interface 1700, the print signal is converted into print data for printing between the gate array 1704 and the MPU 1701. The motor drivers 1706 and 1707 are driven. In addition, the printheads H1000 and H1001 are driven in accordance with the print data sent to the head driver 1705 so that printing is executed.

Embodiment

Figure 1:
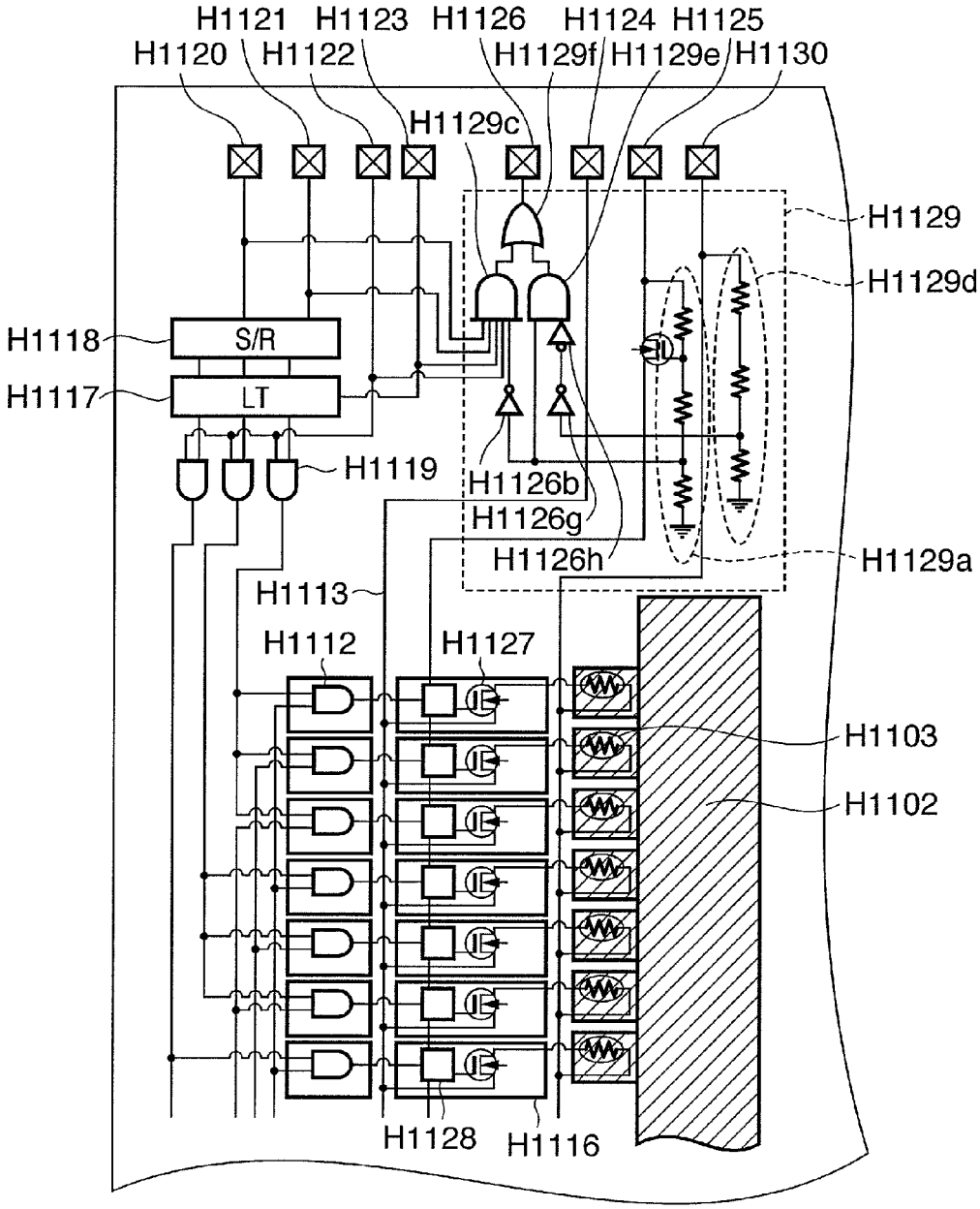
FIG. 1 is a circuit diagram showing the circuit arrangement of an inkjet printhead element substrate according to the present invention.

FIG. 1 is a circuit diagram showing the circuit arrangement of the printhead H1001 according to an embodiment of the present invention. Note that the first printing element substrate H1100 has semiconductor elements and wirings formed on the Si substrate H1110 by a semiconductor process. The printhead H1001 of this embodiment has an n number of nozzles per array for the ink supply port H1102. The electrothermal transducer H1103 serving as a printing element for heating ink in a nozzle and a driving element block H1116 for driving the electrothermal transducer H1103 are provided in correspondence with each nozzle. Each driving element block H1116 has a driver unit H1127 such as a power MOS transistor serving as a driving element for driving the corresponding electrothermal transducer H1103. Each driving element block H1116 also has a level converter H1128 which makes the gate voltage of the driver higher than the voltage (normally 3.3 V) of the logical circuit to improve the capability of the driver. The voltage input to the level converter H1128 is the same as the driving voltage (VH, e.g., 24 V) for driving the electrothermal transducer H1103. The voltage is applied from the inkjet printing apparatus to a VHT terminal H1125 to drive the power MOS transistor serving as the driving element. For the sake of, e.g., the breakdown voltage in the level converter H1128, the voltage is dropped (about 14 V) by dividing it using a resistor provided in the element substrate or by providing a buffer.

The electrothermal transducer, driving element, and ink discharge nozzle will collectively be referred to as a printing component.

The printhead H1001 has, as electrical contacts to the printing apparatus main body, a print data input terminal H1121 for inputting print data (DATA), and a clock signal input terminal H1120 for inputting a clock (CLK) to input the print data in synchronism with it. The printhead H1001 also has a latch signal input terminal H1123 for inputting a latch signal (LT) to a latch circuit H1117, and a heat signal input terminal H1122 for inputting a heat signal (HE) which enables the driving element H1116 for driving the electrothermal transducer H1103. The printhead H1001 in FIG. 1 employs divisional drive to divide n printing components into a plurality of blocks and drive every block.

The printhead H1001 is driven in accordance with the following procedure.

Print data is input from the print data input terminal H1121 in synchronism with the clock input from the clock signal input terminal H1120 and held. A shift register H1118 sequentially holds the print data. When the shift register H1118 holds print data corresponding to a predetermined number of bits, a latch signal is input to the latch signal input terminal H1123. The latch circuit H1117 of the stage next to the shift register H1118 latches the print data in accordance with that of the latch signal. An AND circuit H1119 calculates the logical product between the heat signal input to the heat signal input terminal H1122 and the print data output from the latch circuit H1117. A decoder (not shown) outputs a block selection signal (BLE) to divisionally drive the n electrothermal transducers H1103. An AND circuit H1112 calculates the logical product between the block selection signal and the signal output from the AND circuit H1119. A nozzle corresponding to a printing component selected by the signal output from the AND circuit H1112 discharges ink to execute printing.

A procedure of confirming the electrical connection status between the printhead H1001 and the inkjet printing apparatus will be described next. In this specification, "normal electrical connection status" indicates a state wherein the printhead and printing apparatus are in contact at their contact portions without any short circuit in a connection terminal or wiring.

The printhead H1001 is attached to the carriage 102 of the printing apparatus main body shown in FIG. 7. Contact portions (not shown) to connect electrical contacts are provided between the carriage 102 and the printhead H1001. When the printhead H1001 is attached to the carriage 102, the contact portions come into contact with the electrode portions H1104 which are provided on the printhead H1001 to transmit/receive various electrical signals so that the printhead and carriage are electrically connected. As a unit for confirming the electrical connection status to the printing apparatus main body, the printhead H1001 has a connection status output circuit H1129 as a characteristic feature of the present invention, and a connection status output terminal H1126 (CNO) which outputs the calculation result of the circuit to the printing apparatus main body. Note that the connection status output circuit H1129 outputs a logical signal (e.g., a low-voltage signal of about 3.3 V).

Reference numeral H1124 in FIG. 1 denotes a ground wiring terminal of the electrothermal transducers H1103; and H1113, a wiring from the ground wiring terminal H1124.

<Connection Status Output Circuit>

Figure 3A:
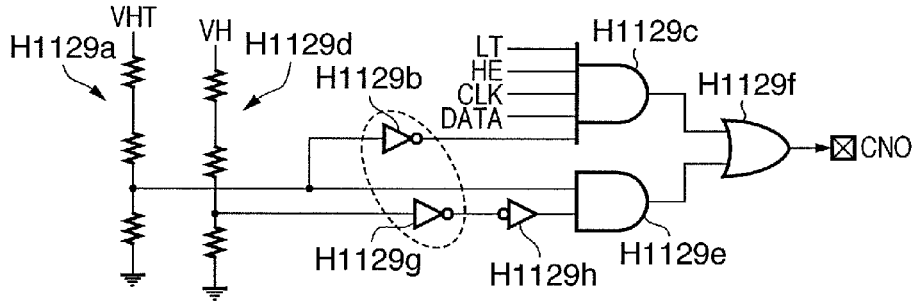
FIGS. 3A and 3B are a circuit diagram showing a connection confirming circuit as a characteristic feature of the present invention and a timing chart showing the timing for confirming a connection status, respectively.

FIG. 3A shows an example of the connection status output circuit H1129 of the present invention. The connection status output circuit H1129 includes an AND circuit H1129*c* which calculates the logical product between the logical signals LT, HE, CLK, and DATA and a voltage that is applied from the VHT terminal H1125 (a terminal for applying a driving voltage to drive a power MOS transistor and the like), dropped by a resistance type voltage divider H1129*a*, and output from an inverter H1129*b*. The connection status output circuit H1129 also includes an AND circuit H1129*e* which calculates the logical product between the voltage applied from the VHT terminal H1125 and dropped by the resistance type voltage divider H1129*a* and a voltage applied from a VH terminal H1130 (a terminal for applying a driving voltage to drive an electrothermal transducer), dropped by a resistance type voltage divider H1129*d*, and output through two inverters H1129*g* and H1129*h*. The connection status output circuit H1129 also includes an OR circuit H1129*f* which calculates the logical sum between the output from the AND circuit H1129*c* and the output from the AND circuit H1129*e*.

The inverters H1129*b* and H1129*g* readily invert the input from Low to High (or the output from High to Low) because they have a low threshold voltage of about 1.0 to 1.5 V. This aims at changing the output signal from the CNO when the voltage input from the VHT and VH terminals to the connection status output circuit becomes slightly higher (e.g., 4 to 7 V) than the voltage (3.3 V) for driving the AND circuits in the connection status output circuit. Additionally, only specific inverters (H1129*b* and H1129*g*) have a low threshold so that when the voltage from the VHT and VH terminals reaches the ultimate voltage (e.g., 24 V), the output can be lower than a voltage (e.g., 7 V or less) lower than the breakdown voltage of the AND circuits in the connection status output circuit. Note that the threshold of an inverter can be changed by changing the gate width and gate length of the NMOS or PMOS transistor in the inverter.

<Connection Status Confirmation Procedure>

Figure 3B:
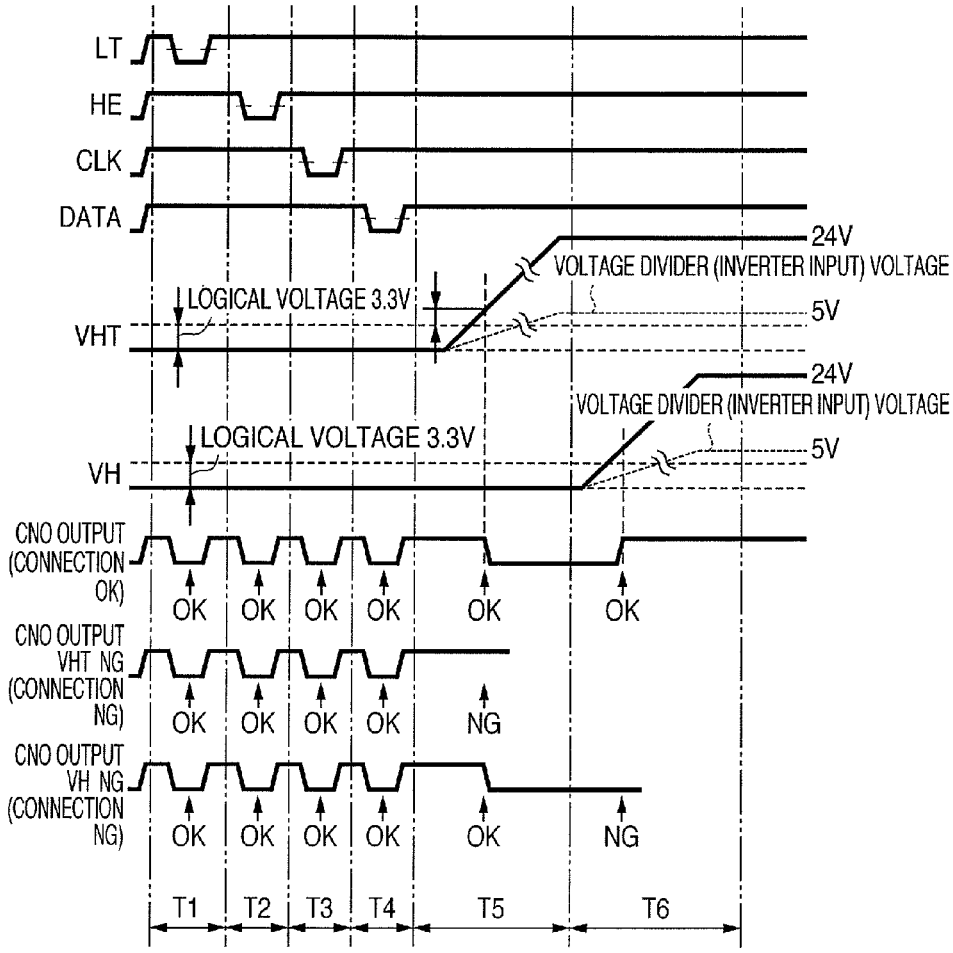

FIG. 3B is a timing chart showing the signals input from the printing apparatus to the printhead and the signal (CNO signal) output from the connection status output terminal H1126 in confirming the connection status between the printhead H1001 and the printing apparatus main body.

In T1 to T4, it is confirmed whether the input terminals of the signals LT, HE, CLK, and DATA are correctly connected. In T1 to T4, the voltage from the VHT terminal is not input yet (when the voltage input from the VHT terminal is 0 V, the output from the inverter H1129*b* is High, and the AND circuit H1129*c* is operable).

First, all the input terminals of the signals are set to High such that the CNO outputs a High signal. If the CNO output is not High at this time point, at least one of the LE, HE, CLK, and DATA terminals already has a connection error. In T1, when the printing apparatus main body inputs a Low signal to only the LT signal input terminal, and the output signal from the CNO changes to Low in synchronism with the LT signal, the LT signal input terminal is correctly connected. The printing apparatus main body confirms the output signal from the CNO, thereby determining the connection status of the LT signal input terminal.

In T2 to T4, it is individually confirmed in the same way whether the signal input terminals are connected.

After the printing apparatus confirms based on the output signals from the CNO in T1 to T4 that the signal input terminals are correctly connected, connection of high-voltage application terminals is confirmed by using the connection status output circuit. As a characteristic feature of this connection confirmation, whether the connection status is normal can be confirmed not only when a high-voltage application terminal (VHT terminal or VH terminal) is not connected and is open but also when the terminal is short-circuited to another terminal (e.g., logical signal terminal with a low breakdown voltage) due to some error. First, voltage application from the VHT terminal to drive a driving element starts. The leading edge of the voltage input from the VHT terminal or VH terminal is relatively slow (msec order) as compared to the voltage change speed (nsec order) of the logical circuit because a capacitor (not shown) provided in, e.g., the carriage 102 of the printing apparatus needs to be charged to apply a stable voltage to the printing elements. Assume that the voltage input from the VHT terminal or VH terminal steeply reaches a high voltage (24 V). If a short circuit has already occurred at the time of connection status confirmation, the printhead or printing apparatus may already be damaged. In the apparatus of this embodiment, however, the voltage rises relatively slowly, as described above. For this reason, the connection status of the VHT terminal or VH terminal is confirmed at a relatively low voltage that rarely damages the printhead or printing apparatus even if a short circuit has already occurred. If an abnormality is confirmed at the time of connection status confirmation, the printhead and printing apparatus can be protected from damage by turning off the power immediately. Confirmation of the connection status of the VHT terminal or VH terminal is preferably done at a relatively low voltage. However, when these terminals are short-circuited to, e.g., the logical signal input terminals, no potential difference is generated at the same voltage as the logical signals, and sufficient confirmation cannot be executed. To prevent this, this embodiment employs an arrangement that allows to determine that connection is correctly done when a voltage higher than the voltage of the logical signals by a predetermined value is input to the VHT terminal or VH terminal. More specifically, connection status can be confirmed when the voltage input from the VHT terminal or VH terminal is higher than the voltage (e.g., 3.3 V) to drive the logical circuit on the printhead element substrate and lower than the general breakdown voltage (e.g., 7 to 8 V) of the logical circuit. More concretely, setting is done such that the printing apparatus confirms the connection status when the voltage starts to be normally applied to the VHT terminal or VH terminal, and the applied voltage reaches, e.g., 5V. In addition, the voltage-dividing resistances are determined such that when the voltage input from the VHT terminal or VH terminal has reached the ultimate high voltage (e.g., 24 V) necessary for driving the printing elements, the voltage that is divided and input to the logical circuit to confirm the connection status of the VHT terminal or VH terminal becomes lower than the breakdown voltage (e.g., 7 to 8 V) of the logical circuit.

The voltage-dividing resistance of the VHT terminal or VH terminal will be described in detail. In this embodiment, the voltage of the logical circuit is 3.3 V, the breakdown voltage of the logical circuit is 7 V, and the voltage to drive the printing elements is 24 V. The voltage-dividing resistance is set to drop the voltage applied to the VHT terminal or VH terminal to ¼ when it is applied to the connection status output circuit.

When a voltage of 24 V is applied to the VHT terminal or VH terminal, the voltage drops to ¼ so that a voltage of 6 V is input to the logical circuit for connection status confirmation. Since this voltage is lower than the breakdown voltage, 7 V, of the logical circuit. With this setting, when the voltage applied to the VHT terminal or VH terminal has reached 5 V, the voltage dropped by the voltage-dividing resistance is 1.25 V. Hence, the threshold of the inverters H1129*b* and H1129*g* in the connection status output circuit is set to 1.25 V. In a normal connection status, the output from the connection status output circuit changes when a voltage of 5 V is applied from the printing apparatus to the head cartridge. This allows connection status determination. If an open state has occurred due to a connection failure, no voltage is applied to the inverter H1129*b* or H1129*g* in the connection status output circuit even when the voltage output from the printing apparatus side reaches 5 V. It is therefore possible to determine the abnormality of the connection status. When the VHT terminal or VH terminal is open, and the terminal in the open state is short-circuited to any one of the logical signal input terminals, a voltage of 0.825 V, i.e., ¼ of 3.3 V is applied to the inverter H1129*b* or H1129*g*. In this case, the inverter H1129*b* or H1129*g* does not invert the signal because the threshold is 1.25 V. It is therefore possible to determine the abnormality of the connection status. Even when the VHT terminal or VH terminal is not open and is short-circuited to another terminal due to some error, no voltage higher than the threshold is applied to the logical circuit for connection status confirmation because, e.g., the voltage cannot reach 5 V due to a leakage current, or the timing to reach 5 V delays. It is possible for these reasons to determine the abnormality of the connection status on the printing apparatus side (The current to be flowed to the VH terminal or VHT terminal in connection confirmation is preferably limited because a voltage difference more readily occurs between the short-circuit state and the normal state).

FIG. 3B shows three different timings when the connections of all the logical signal input terminals, VHT terminal, and VH terminal are OK, when the connection of the VHT terminal is NG, and when the connection of the VH terminal is NG. The input to the terminals is preferably done in an order of logical signal input terminals, VHT terminal, and VH terminal. When the connections of the input terminals of logical signals (e.g., a low voltage of 3.3 V) are confirmed, and then, a VHT voltage obtained by boosting the logical signals is input to control and drive the printing elements, any unexpected driving of the printing elements can be prevented. Additionally, when a VH voltage to supply energy to the printing elements is applied after that, any operation error can be prevented.

In this embodiment, both the connection of the VHT terminal and that of the VH terminal have been described. However, depending on the positional relationship of electrical contacts between the printing apparatus and the head cartridge, damage in attaching the head cartridge can effectively be prevented by confirming only one of the terminals. For example, in some cases, if the connection status of one terminal is normal in attaching the head cartridge, the connection status of the other terminal also relatively reliably becomes normal on the basis of the positional relationship between the terminal positions of the head cartridge and those of the printing apparatus. When the VHT terminal for inputting the voltage to drive the printing elements is open, the electrothermal transducers may malfunction because they are unstably driven. Hence, the effect of preventing the head cartridge from breaking can be obtained by confirming only the VHT terminal.

The logic explained in this embodiment is merely an example, and the present invention incorporates any arrangement with a connection status confirmation unit including the logical signal input terminals, a power supply terminal for driving the electrothermal transducers, and a power supply terminal for driving the driving elements.

Figure 2:
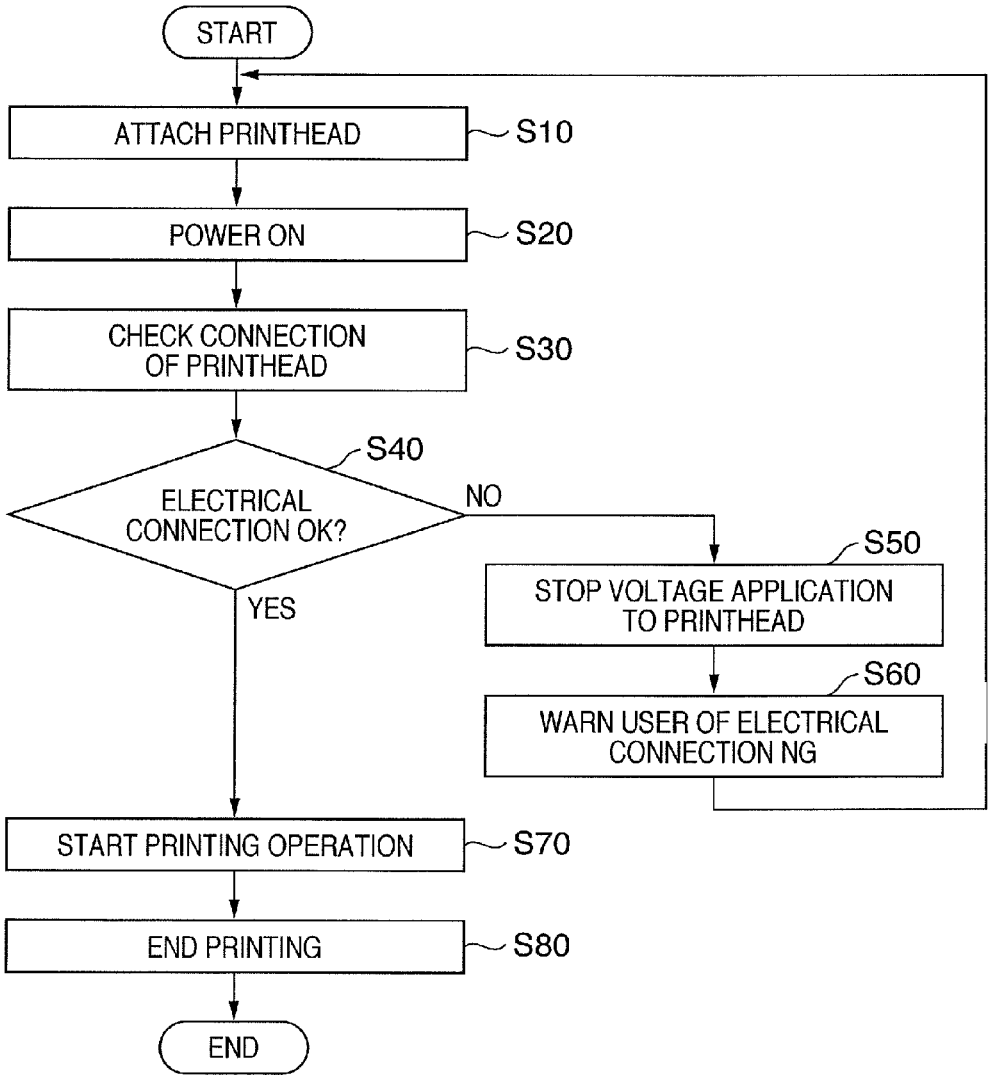
FIG. 2 is a flowchart illustrating a sequence of confirming a connection status in an inkjet printing apparatus according to the present invention.

FIG. 2 shows a sequence from printhead attachment to the end of printing in a printhead substrate, printhead, and printing apparatus according to the present invention.

In step S10, the printhead is attached to the carriage of the printing apparatus. In step S20, the printing apparatus is powered on. In step S30, it is checked whether the printhead is normally connected. More specifically, it is confirmed in step S40 whether the electrical connection between the printing apparatus and each input terminal of the printhead is normal. If the electrical connection is not normal, voltage application to the printhead is stopped in step S50. In step S60, the user is warned of the abnormal electrical connection. This warning is done by turning on the LED provided on the printing apparatus or displaying a message on the host apparatus, thereby notifying the user of the printing apparatus that the electrical connection is not normal. If the electrical connection status is normal, the printing operation starts in step S70. After desired printing is executed, printing is ended in step S80.

The printing apparatus according to the present invention may take not only the form of an integrated or separate image output terminal of an information processing device such as a computer but also the form of a copying apparatus combined with a reader or the like, or the form of a facsimile apparatus having a transmission and reception function.

The above embodiment has been described by exemplifying an element substrate for an inkjet printhead. However, the embodiment is also applicable to an element substrate for a printhead using a thermal transfer method or a printhead of sublimation type.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-327625, filed Dec. 4, 2006, which is hereby incorporated by reference herein in its entirety.

What is claimed is:

1. An element substrate for a printhead, which is detachable from a printing apparatus, comprising:

a plurality of printing elements;

a voltage application terminal for applying a driving voltage to drive the plurality of printing elements;

a logical circuit which controls the plurality of printing elements;

a signal input terminal for inputting a logical signal with a logic voltage lower than the driving voltage to the logical circuit; and a connection status output terminal which outputs a connection signal based on a first status signal indicating a connection status between the printing apparatus and the voltage application terminal and a second status signal indicating a connection status between the printing apparatus and the signal input terminal.

2. The substrate according to claim 1, wherein the connection status output terminal is connected to a connection status output circuit configured to output the connection signal to the connection status output terminal based on the first and second status signals, and the connection status output circuit comprises:

an inverter which, when the driving voltage applied from the voltage application terminal exceeds a threshold, inverts a logic signal level derived from the driving voltage and outputs an inverted signal; and an OR circuit which performs an OR operation of the inverted signal outputted from the inverter and the logical signal to output the connection signal.

3. The substrate according to claim 2, further comprising a voltage division register for reducing the driving voltage, wherein the inverter inverts the logic signal level, based on the reduced driving voltage.

4. The substrate according claim 2, wherein when the driving voltage higher than the logic voltage is applied, the inverter inverts the logic signal level.

5. The substrate according to claim 1, wherein each of the plurality printing elements comprises an electrothermal transducer for generating thermal energy utilized for discharging liquid.

6. A method of examining a connection status between a printing apparatus and a printhead which incorporates an element substrate according to claim 1, comprising the steps of:

applying the logic voltage to the signal input terminal at a first timing; and applying the driving voltage to the voltage application terminal at a second timing different from the first timing.

7. A printhead, which is detachable from a printing apparatus, including an element substrate, the substrate comprising:

a plurality of printing elements;

a voltage application terminal for applying a driving voltage to drive the plurality of printing elements;

a logical circuit which controls the plurality of printing elements;

a signal input terminal for inputting a logical signal with a logic voltage lower than the driving voltage to the logical circuit; and a connection status output terminal which outputs a connection signal based on a first status signal indicating a connection status between the printing apparatus and the voltage application terminal and a second status signal indicating a connection status between the printing apparatus and the signal input terminal.

8. A head cartridge having an ink tank containing ink, and a printhead, the cartridge being detachable from a printing apparatus, and including an element substrate, the substrate comprising:

a plurality of printing elements;

a voltage application terminal for applying a driving voltage to drive the plurality of printing elements;

a logical circuit which controls the plurality of printing elements;

a signal input terminal for inputting a logical signal with a logic voltage lower than the driving voltage to the logical circuit; and a connection status output terminal which outputs a connection signal based on a first status signal indicating a connection status between the printing apparatus and the voltage application terminal and a second status signal indicating a connection status between the printing apparatus and the signal input terminal.

9. A printing apparatus to/from which a printhead is attachable and detachable, wherein the printhead includes an element substrate comprising a plurality of printing elements, a voltage application terminal for applying a driving voltage to drive the plurality of printing elements, a logical circuit which controls the plurality of printing elements, a signal input terminal for inputting a logical signal with a logic voltage lower than the driving voltage to the logical circuit, and a connection status output terminal which outputs a connection signal based on a first status signal indicating a connection status between the printing apparatus and the voltage application terminal and a second status signal indicating a connection status between the printing apparatus and the signal input terminal, the apparatus comprising:

an input unit configured to input the connection signal;

a determination unit configured to determine the electrical connection status, based on the connection signal inputted by the input unit; and a control unit configured to control to halt a voltage application to the printhead before the voltage applied to the printhead exceeds a tolerable voltage of the logical circuit in a case where the determination unit determines that the electrical connection status is abnormal.

10. The apparatus according to claim 9, further comprising a notification unit configured to notify the abnormality of the electrical connection in a case where the determination unit determines that the electrical connection status is abnormal.

11. An element substrate for a printhead, which is detachable from a printing apparatus, comprising:

a plurality of printing elements;

a plurality of driving elements;

a first voltage application terminal for applying a first driving voltage to drive the plurality of driving elements, each ON/OFF-controlling one of the plurality of printing elements;

a second voltage application terminal for applying a second driving voltage to the plurality of printing elements so as to supply an electric current to the plurality of printing elements to drive the plurality of printing elements;

a logical circuit which controls the plurality of printing elements;

a signal input terminal for inputting a logical signal with a logic voltage lower than the first and second driving voltages to the logical circuit; and a connection status output terminal which outputs a connection signal based on a first status signal indicating a connection status between the printing apparatus and the second voltage application terminal, a second status signal indicating a connection status between the printing apparatus and the signal input terminal, and a third status signal indicating a connection status between the printing apparatus and the first voltage application terminal.

12. The substrate according to claim 11, wherein the connection status output terminal is connected to a connection status output circuit configured to output the connection signal to the connection status output terminal based on the first, second and third status signals, and the connection status output circuit comprises:

a first inverter which, when a first divided voltage obtained from dividing the second driving voltage applied from the second voltage application terminal exceeds a first threshold, inverts a logic signal level derived from the first divided voltage and outputs a first inverted signal;

a second inverter which inverts a the first inverted signal outputted from the first inverter and outputs a second inverted signal;

a third inverter which, when a second divided voltage obtained from dividing the first driving voltage applied from the first voltage application terminal exceeds a second threshold, inverts a logic signal level derived from the second divided voltage and outputs a third inverted signal;

a first AND circuit which performs an AND operation of the logical signal and the third inverted signal outputted from the third inverter;

a second AND circuit which performs an AND operation of the second divided voltage and the second inverted signal outputted from the second inverter; and an OR circuit which performs an OR operation of an output signal from the first AND circuit and an output signal from the second AND circuit to output the connection signal.

13. A method of examining a connection status between a printing apparatus and a printhead which incorporates an element substrate according to claim 11, comprising the steps of:

applying the logic voltage to the signal input terminal at a first timing;

applying the first driving voltage to the first voltage application terminal at a second timing different from the first timing; and applying the second driving voltage to the second voltage application terminal at a third timing different from the first and second timings.

* * * * *